US006814144B2

(12) United States Patent
Jones

(10) Patent No.: US 6,814,144 B2
(45) Date of Patent: Nov. 9, 2004

(54) WELL TREATING PROCESS AND SYSTEM

(75) Inventor: Lloyd G. Jones, Granbury, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 14 days.

(21) Appl. No.: 10/298,698

(22) Filed: Nov. 18, 2002

(65) Prior Publication Data

US 2004/0094299 A1 May 20, 2004

(51) Int. Cl.[7] ..... E21B 33/16

(52) U.S. Cl. ..... 166/281; 166/189; 166/192; 166/236

(58) Field of Search ..... 166/114–116, 157, 166/158, 189, 191, 192, 281, 290, 307, 308.1, 227, 236

(56) References Cited

U.S. PATENT DOCUMENTS 5,113,935 A 5/1992 Jones et al.
5,161,613 A 11/1992 Jones
5,161,618 A 11/1992 Jones et al.
5,165,476 A 11/1992 Jones
5,417,284 A 5/1995 Jones
5,419,394 A 5/1995 Jones
5,435,391 A 7/1995 Jones
5,848,645 A 12/1998 Jones
5,947,200 A * 9/1999 Montgomery ..... 166/281
6,073,696 A 6/2000 Ellis
6,220,345 B1 4/2001 Jones et al.
6,227,303 B1 5/2001 Jones

* cited by examiner

*Primary Examiner*—Zakiya Walker

(57) ABSTRACT

A method for the treatment of a subterranean formation penetrated by a well in which, first and second flow paths are established from the wellhead into the vicinity of the formation. A plugging fluid comprising a suspension of a particulate plugging agent in a carrier liquid is circulated into the first flow path and into contact with the wall of the well within the subterranean formation. The carrier liquid is separated from the particulate plugging agent by circulating the carrier liquid through a set of openings leading to the second flow path, which are dimensioned to allow the passage of the carrier liquid while retaining the particulate plugging agent in contact with the set of openings. The circulation of the plugging fluid continues until the particulate plugging agent accumulates to form a bridge packing within the well. Subsequent to establishing the bridge packing, a treating fluid is introduced into the well through the first flow path and in contact with the surface of the formation in the well adjacent to the bridge packing. The treating fluid may be a fracturing fluid under or an acidizing fluid. A clean-up fluid is circulated into the second flow path to remove the bridge packing.

25 Claims, 5 Drawing Sheets

WELL TREATING PROCESS AND SYSTEM

FIELD OF THE INVENTION

This invention relates to the treatment of wells penetrating subterranean formations and more particularly to the isolation of an interval within a well for the introduction of a treating fluid into an adjacent formation.

BACKGROUND OF THE INVENTION

Various treatment procedures are known in the art for the treatment of a well penetrating a subterranean formation. One common treatment procedure involves the hydraulic fracturing of a subterranean formation in order to increase the flow capacity thereof. Thus, in the oil industry, it is a conventional practice to hydraulically fracture a well in order to produce fractures or fissures in the surrounding formations and thus facilitate the flow of oil and/or gas into the well from the formation or the injection of fluids from the well into the formation. Such hydraulic fracturing can be accomplished by disposing a suitable fracturing fluid within the well opposite the formation to be fractured. The well is open to the formation by virtue of openings in a conduit, such as a casing string, or by virtue of an open completion in which a casing string is set to the top of the desired open interval and the formation face then exposed directly to the well below the shoe of the casing string. In any case, sufficient pressure is applied to the fracturing fluid and to the formation to cause the fluid to enter into the formation under a pressure sufficient to break down the formation with the formation of one or more fractures. Oftentimes the formation is ruptured to form vertical fractures. Particularly, in relatively deep formations, the fractures are naturally oriented in a predominantly vertical direction. One or more fractures may be produced in the course of a fracturing operation, or the same well may be fractured several times at different intervals in the same or different formation.

Another widely used treating technique involves acidizing, which is generally applied to calcareous formations such as limestone. In acidizing, an acidizing fluid such as hydrochloric acid is introduced into the well and into the interval of the formation to be treated which is exposed in the well. Acidizing may be carried out as so-called "matrix acidizing" procedures or as "acid fracturing" procedures. In acid fracturing, the acidizing fluid is injected into the well under a sufficient pressure to fracture the formation in the manner described previously. An increase in permeability in the formation adjacent the well is produced by the fractures formed in the formation as well as by the chemical reaction of the acid with the formation material. In matrix acidizing, the acidizing fluid is introduced through the well into the formation at a pressure below the breakdown pressure of the formation. In this case, the primary action is an increase in permeability primarily by the chemical reaction of the acid within the formation with there being little or no effect of a mechanical disruption of the formation, such as occurs in hydraulic fracturing.

Various other treatment techniques are available for increasing the permeability of a formation adjacent a well or otherwise imparting a desired characteristic to the formation. For example, solvents can sometimes be involved as a treating fluid in order to remove unwanted material from the formation in the vicinity of the well bore.

SUMMARY OF THE INVENTION

In accordance with the present invention, there is provided a method for the treatment of a subterranean formation penetrated by a well. In carrying out the invention, first and second flow paths are established within the well, extending from the wellhead into the vicinity of the subterranean formation. A plugging fluid comprising a suspension of a particulate plugging agent in a carrier liquid is circulated into the first of the flow paths and into the well in contact with the wall of the well within the subterranean formation. The carrier liquid is separated from the particulate plugging agent by circulating the carrier liquid into a second flow path. Circulation of the liquid is accomplished through a set of openings leading to the second flow path, which are dimensioned to allow the passage of the carrier liquid while retaining the particulate plugging agent in contact with the set of openings. The circulation of the plugging fluid continues until the particulate plugging agent accumulates to form a bridge packing within the well. The bridge packing acts similarly as a mechanical packer to form a barrier within the well. Subsequent to establishing the bridge packing, a treating fluid is introduced into the well through the first flow path and in contact with the surface of the formation in the well adjacent to the accumulated plugging agent forming the bridge packing.

In a further aspect of the invention, a treatment procedure is carried out in a section of a well penetrating a subterranean formation and having a return tubing string provided with spaced screened sections at a location in the well adjacent the subterranean formation. A working tubing string opens into the interior of the well intermediate the spaced screen sections. In carrying out the invention, a plugging agent comprising a suspension of particulate plugging agent in a carrier liquid is circulated through the working string into the intermediate interval between the screen sections. The carrier liquid is flowed through openings in the spaced screen section, which are sized to allow the passage of the carrier liquid while retaining the particulate plugging agent in the well in contact with the screen sections. The flow of the plugging agent within the well is continued until the particulate plugging agent in the fluid accumulates in the well adjacent the screen sections to form spaced bridge packings within the well and surrounding the return string. Thereafter, a treating fluid is introduced into the well and into the interval of the well intermediate the spaced bridge packings and introduced into the formation. In a specific application of the invention, the treating fluid is a fracturing fluid introduced into the treating interval under pressure sufficient to hydraulically fracture the formation. In another embodiment of the invention, the treating fluid is an acidizing fluid effective to acidize the formation in either a matrix acidizing or acid fracturing operation. Preferably, subsequent to the introduction of the treating fluid into the well, a clean-up fluid is circulated down the well into the return tubing string to displace the accumulated particulate plugging agent away from the screened sections and disrupt and remove the bridge packings. In carrying out the hydraulic fracturing operations, the fracturing fluid is normally in the nature of a cross-linked gel having a high viscosity. The clean-up fluid can incorporate a breaker to break down the viscosifying agent in the fracturing fluid. For example, where the viscosifier in an aqueous-based fracturing agent takes the form of hydroxethylcellulose, the clean-up fluid can incorporate an acid such as hydrochloric acid, which functions to break the fracturing fluid gel to a liquid of much lower viscosity. Subsequently, the tubing strings can be moved longitudinally through the well to a second location within the well bore spaced from the originally treated location and the operation then repeated to treat a different section of the well bore. The tubing strings employed in carrying out the invention may be parallel tubing strings or they may be concentrically oriented tubing strings in which the working string disposed within the return string provides a return pathway formed by the annulus of the working string and the return string.

In a further application of the invention, a treating process is carried out in a well section that extends in a horizontal orientation within the subterranean formation. The fracturing operation is carried out to hydraulically fracture the formation and form a vertically oriented fracture within the formation extending from the horizontally oriented well bore. Thereafter, the return and working strings are moved longitudinally through the horizontally extending well section to a second location, and the operation is repeated to form a second set of bridge packings followed by hydraulic fracturing to form a second vertically oriented fracture within the well section spaced at some distance from the initially formed vertically oriented fracture. These operations can be repeated as many times as desired in order to produce multiple fractures.

DETAILED DESCRIPTION OF THE INVENTION

The present invention provides for the formation of one or more downhole bridge packings which can be placed at precise locations in a well by fluid circulation techniques in order to permit well-defined access to a formation by a suitable treating agent. The bridge packings can be assembled within the well without the use of special downhole mechanical packings and can be readily removed after the treatment procedure by a reverse circulation technique. The bridge packings are formed by the circulation downhole of a particulate plugging agent which is suspended in a suitable carrier liquid. The plugging fluid is circulated through a downhole screen at a desired location which permits the suspending liquid to readily flow through the screen openings but retards passage of the particulate plugging agent so that it accumulates in the well at the desired downhole location. The plugging agent may take the form of gravel or a gravel/sand mixture as described in greater detail below. Other suitable mixtures of porous permeable materials may be employed. The gravel-plugging agent is suspended within a liquid that may be either oil- or water-based for circulation down the well to the desired downhole location. The carrier liquid typically is treated with a thickening agent in order to provide a viscosity, normally within the range of 10–1,000 centipoises, preferably within the range of 30–200 centipoises, which is effective to retain the plugging agent in suspension as the plugging fluid is circulated through the well. However liquids of low viscosity, for example, water having a viscosity of about 1 cp can be used with low density plugging agents.

The invention may be carried out employing tubing sections suspended down hole from a mechanical packer, which may be equipped with a crossover tool, or it may be carried out employing tubing strings which extend from the wellhead to the downhole location of the well being treated. The invention will be described initially with respect to the latter arrangement, which normally will be employed only in relatively shallow wells, in order to illustrate in a simple manner the flow of fluids in the course of carrying out the invention.

Figure 1:
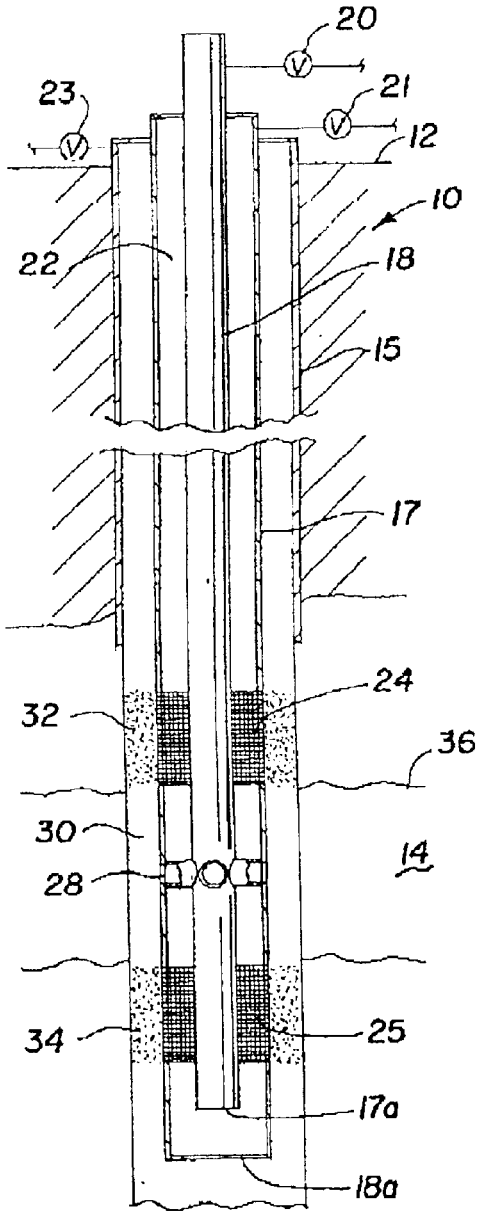
FIG. 1 is a schematic illustration of a well with parts broken away, showing the formation of spaced bridge packings using concentrically oriented tubing strings.

Turning now to the drawings and referring first to FIG. 1, there is illustrated a well 10, which extends from the earth's surface 12 into a subterranean formation 14. Formation 14 may be of any suitable geologic structure and normally will be productive of oil and/or gas. The well 10 is provided with a casing string 15 which extends from the surface of the earth to the top of formation 14. Typically, casing string 15 will be cemented within the well to provide a cement sheath (not shown) between the outer surface of the casing and the wall of the well. It is to be recognized that the well structure of FIG. 1 is highly schematic. While only a single casing string is shown, as a practical matter a plurality of casing strings can be and usually will be employed in completing the well. Also, while FIG. 1 depicts a so-called "open hole" completion, the well may be set with casing and cemented through the formation 14 and the casing then perforated to provide a production interval open to the well.

The well is completed with concentrically run tubing strings comprising an outer tubing 17 and an inner tubing string 18. The tubing strings 17 and 18 are hung in the well from the surface by suitable wellhead support structure (not shown). A flow line equipped with a valve 20 extends from the tubing 18 to allow for the introduction and withdrawal of fluids. A similar flow line with valve 21 extends from tubing string 17 and allows for the introduction and withdrawal of fluids through the annulus 22, defined by the tubing strings 17 and 18. The casing string is provided with a flow line and valve 23 providing access to the tubing-casing annulus. The tubing strings 17 and 18 are both closed at the bottom by closure plugs 17*a* and 18*a*. The tubing string 17 is provided with spaced screen sections 24 and 25. The screen sections may be of any suitable type as long as they provide for openings sufficient to permit the egress and ingress of the liquid carrier while blocking passage of all or at least a substantial portion of the particulate plugging agent. In a typical downhole configuration involving a 4-inch diameter tubing set within a well bore having a nominal diameter of about 8–9 inches, the screen sections may be formulated by grid screens having sieve openings within the range of about 0.006–0.01 inch, corresponding generally to a standard sieves of 60–100 mesh. Other configurations can be used. For example, the screen sections can be provided by perforated sections of tubing or tubing which has been slotted vertically or vertically and horizontally, providing openings sufficient to block the passage of plugging agent. Also, sintered metal screens can be employed. The screen sections may be of any suitable dimension. In a well configuration as described above, the screen sections 24 and 25 may each be about 2–30 feet in length with an interval between the screen sections (from the top of the lower section to the bottom of the upper section) of about 5–30 feet. The downhole well assembly is provided with one or more flow ports such as provided by a spider assembly 28 comprised of a plurality of tubes extending from the interior of tubing string 18 to the exterior of tubing string 17 to permit the flow of fluid between the interior of tubing string 18 and the exterior of tubing string 17.

In carrying out the invention, the slurry of particulate plugging agent in the carrier liquid is circulated through line 20 and down the well through tubing 18. The slurry flows through the downhole spider assembly 28 into the annular space 30 between the wall of the well and the outer surface of tubing 17. Within the well annulus 30, the slurry flows through the screens 24 and 25 into the annulus 22 defined by tubing strings 17 and 18. If desired, a packer (not shown) may be set in the well annulus above screen 24 in order to direct the flow of fluid into the annulus 22 rather than up the well annulus 30. However, this often will be unnecessary. The plugging fluid flowing down the well (having a suspension of gravel or the like in the carrier liquid) will have a higher bulk density than the carrier liquid itself. Thus, as the carrier liquid flows through the screens 24 and 25 causing the granular plugging agent to accumulate in the vicinity of the screens, the pressure gradient across the screens will be less than the pressure gradient up the well. Thus, flow will be predominantly through the screen and into the tubing annulus 22.

At the conclusion of the preliminary circulation step, effective bridge packings 32 and 34 are formed adjacent the screens 24 and 25. The packings are retained in place by the hydrostatic pressure in the well annulus 30, and the packings are sufficiently impermeable to prevent any significant migration of fluid from one side of a packing to the other.

At the conclusion of the formation of the bridging plugs, a suitable treating fluid is injected via line 20 into tubing 18 and through the spider assembly 28 into the space between the bridge packings 32 and 34. By way of example, a fracturing fluid may be injected down tubing 18 and under pressure sufficient to form a fracture 36 in the formation 14. Alternatively, the treating procedure may take the form of an acidizing procedure or an acid fracturing procedure.

Standard procedures can be employed in carrying out the treating operation. Where a fracturing operation is involved, initial spearhead fluid will be injected in accordance with accepted practice under a sufficient pressure to exceed the breakdown pressure of the formation and fracture the formation. Normally the spearhead fluid will be a viscous fluid, typically having a viscosity within the range of 10–1,000 centipoises which is free of propping agent or has a very low propping agent concentration. In order to insure that the bridge packings remain in place during the initial fracturing procedure, the spearhead fluid can incorporate a bridging agent such as sand employed in relatively low concentration, typically within the range of 1–50 pounds per barrel.

After fracturing is initiated in the formation, a fracturing fluid carrying a propping agent, is pumped down tubing 18 to propagate the fracture in the formation and leave it packed with propping agent. Typically a "sand out" condition will occur, as indicated by an increase in pressure, and the fracturing operation is then concluded.

At the conclusion of the treating procedure, the bridge packings may be removed. In order to remove the bridge packings 32 and 34, a reverse circulating fluid, which may be the same or different from the fluid employed as the carrier liquid initially, is injected through valve 21 into the tubing annulus 22. This creates a reverse pressure differential through the screen sections 24 and 25 causes the bridge packings to begin to disintegrate. Ultimately, the bridge packings are removed by the particulate plugging agent becoming suspended in carrier liquid and carried away from the vicinity of the formation. Normally, the particulate plugging agent will be reverse circulated up tubing string 18 to the surface and removed from the well. The suspension of particulate plugging in the carrier liquid can be circulated up the annulus 30. The reverse circulation fluid may be different from the fluid employed as the initial carrier liquid. The reverse circulation fluid may take the form initially of a lower viscosity fluid to facilitate the initial removal of the particulate plugging agent. Where the carrier liquid incorporates a cross linked gel, the reverse circulation flow may contain a breaking agent to help remove the cross-linked gel from the bridge packing. Suitable gelling agents include guar gum or hydroxyethylcellulose. They may be used in any suitable amounts. Typically, they are used in minimum amounts of about 20–25 to perhaps 30 lbs. per thousand gallons. The gel may be broken through the use of oxydizers or enzymes to effect suitable decomposition reactions. Typically, oxydizers are used. Suitable oxidizers include sodium hypochlorite and ammonium persulfate.

Figure 2:
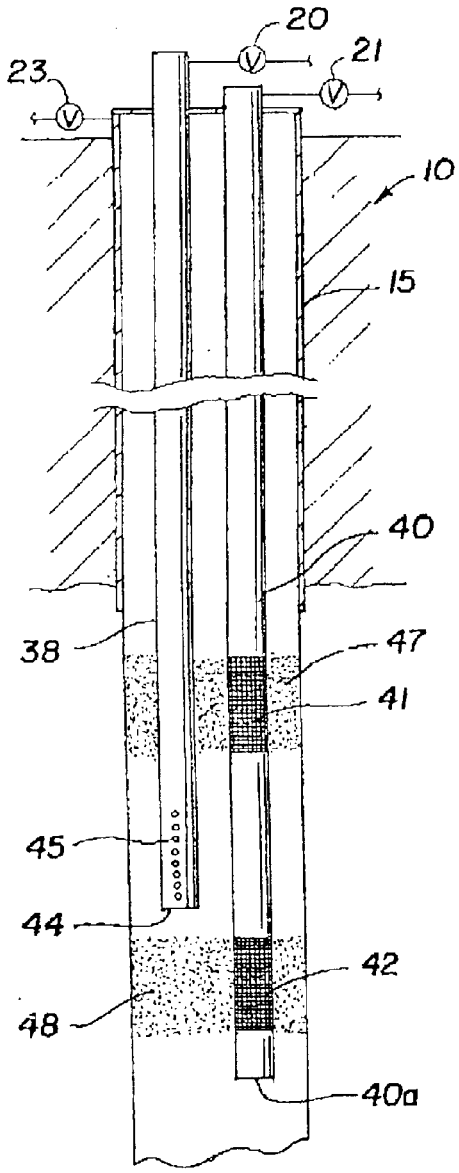
FIG. 2 is a schematic illustration of a well with parts broken away showing the invention as carried out employing parallel tubing strings.

Turning now to FIG. 2, there is illustrated an alternative well structure for use in carrying out the present invention in which parallel tubing strings are employed. In FIG. 2 like elements are designated by the same reference numerals as shown in FIG. 1 and the foregoing description is applicable to FIG. 2 with the exception of the modification involving the use of parallel tubing strings. In FIG. 2, string 38 (analogous in function to tubing string 18) and tubing string 40 (analogous in function to tubing string 17) are run in a parallel configuration. The tubing strings are dimensioned to take into account the parallel configuration. By way of example, in a well having a nominal diameter of 8–9 inches, each of strings 38 and 40 may be 2–3-inch tubing strings. Tubing string 40 is provided with screen sections 41 and 42, which may be configured with respect to the size of the openings, similarly as described above with respect to FIG. 1. Tubing string 40 is closed at its lower end with a suitable plug indicated by reference numeral 40*a*. Tubing string 38 is provided with a closure or seal 44 at its bottom end and is provided with a perforated section 45 to allow for the flow of fluid from tubing 38 into the well bore. Alternatively, instead of providing tubing string 38 with a perforated section, the tubing string may be open at its bottom end to provide for flow of fluids from the interior of the tubing string into the well. In this case the lower end of the tubing sting should be located approximately midway between the locations of the screen sections 41 and 42. The operation of the invention employing the parallel tubing configuration shown in FIG. 2 is similar to the operation employing the concentric tubing strings as shown in FIG. 1. A plugging fluid comprising a suspension of particulate plugging agent is circulated down the well via tubing 38. The openings in the perforated section 45 of tubing 38 are sufficient to permit the passage of the particulate plugging agent in suspension in the carrier liquid without the plugging agent screening out of suspension and accumulating in the interior of the tubing string 38.

The plugging fluid is circulated down tubing 38 into the well and through the screen sections 41 and 42 in order to form bridge packings 47 and 48. As the carrier liquid passes through the screen sections and into tubing string 40, the bridge packings 47 and 48 are formed similarly as described above. At the conclusion of formation of the bridge packings, the treating fluid is then injected down tubing string 38 and into the interval of the well between bridge packings 47 and 48 to carry out the desired treating operation. At the conclusion of the treating operation, the bridge packings 47 and 48 may be removed by circulation of the viscous carrier liquid down the well in tubing string 40. Alternatively, a different fluid may be used as described previously.

Figure 3:
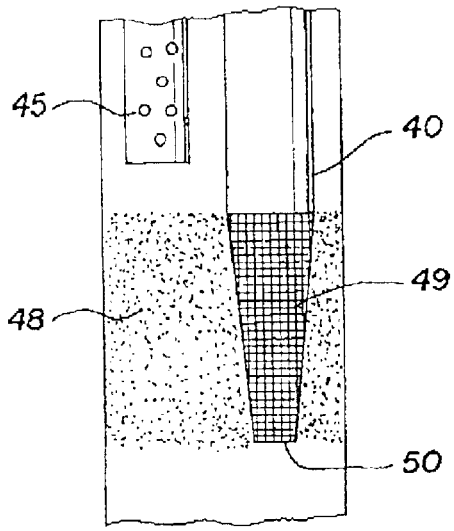
FIG. 3 is a schematic illustration of a section of a well showing a preferred form of screen section in a parallel string configuration.

In carrying out the invention with the parallel tubing configuration of FIG. 2, the lower bridge packing 47 will occupy a substantially greater cross-sectional area of the well bore than in the case of employing concentric tubing strings. In a preferred embodiment of the invention, in order to facilitate removal of the lower screen section in conjunction with dispersion of the bridge packing, the lower screen section can be formed in a tapered configuration. This embodiment of the invention is shown in FIG. 3, in which the tubing 40 is shown to terminate in a tapered screen section 49. By way of example, where the tubing string 40 is a 3-inch tubing, the screen section may taper downwardly to provide a lower dimension indicated by reference numeral 50 of about half of the dimension of the tubing string.

Figure 4:
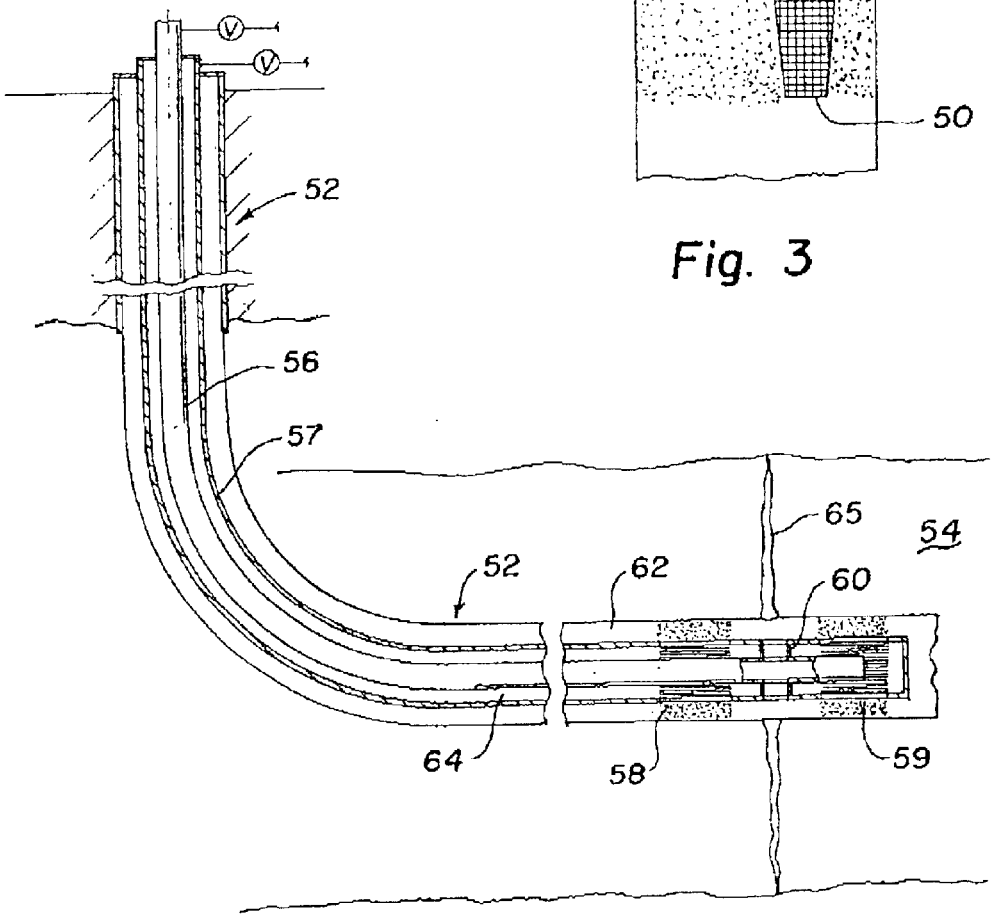
FIG. 4 is a schematic illustration of a well with parts broken away showing the application of the invention in a deviated well having a horizontal well section within a subterranean formation.

A preferred application of the present invention is in carrying out multiple treatments in a single wellbore. This is facilitated by the fact that the bridge packings can be readily removed by a reverse circulation technique, the tubing assembly then moved to a new location in the well, and a new set of bridge packings put in place. This mode of operation is particularly advantageous in the operation of wells in which the producing section is slanted substantially from the vertical in some cases to a nominally horizontal orientation. Such horizontal well bores are typically employed in relatively thick gas or oil formations where the slant well follows generally the dip of the formation and especially where the formation permeability is relatively low. Such slant wells or horizontal wells can be formed by any suitable technique. One technique involves the drilling of a vertical well followed by the use of whipstocks to progressively deviate from the vertical in a direction to arrive at the horizontal orientation. Such horizontal wells may also be formed using coiled tubing equipment of the type disclosed, for example, in U.S. Pat. No. 5,215,151 to Smith et al. Turning now to FIG. 4, there is illustrated a well 52 which has been deviated from the vertical into a horizontal configuration to generally follow the dip of subterranean formation 54. The well is equipped with a concentric tubing arrangement having inner and outer tubing strings 56 and 57 corresponding generally to the tubing strings 17 and 18 of FIG. 1. The outer tubing string 57 is equipped with upper and lower screen sections 58 and 59, which are disposed above and below a spider assembly 60 providing for the flow of fluid between the interior of tubing string 56 and the exterior of tubing string 57. In operation of the system of FIG. 4, the suspension of a particulate plugging agent is circulated down tubing string 56 and through spider assembly 60 into the annulus 62 between the wall of the well 52 and the outer tubing string 57. The carrier liquid flows through the screen elements 58 and 59 and into the tubing annulus 64, resulting in the formulation of bridge packings similarly as described above. A tubing fracturing operation is then initiated in order to form one or more vertical fractures as indicated by reference character 65.

Figure 5:
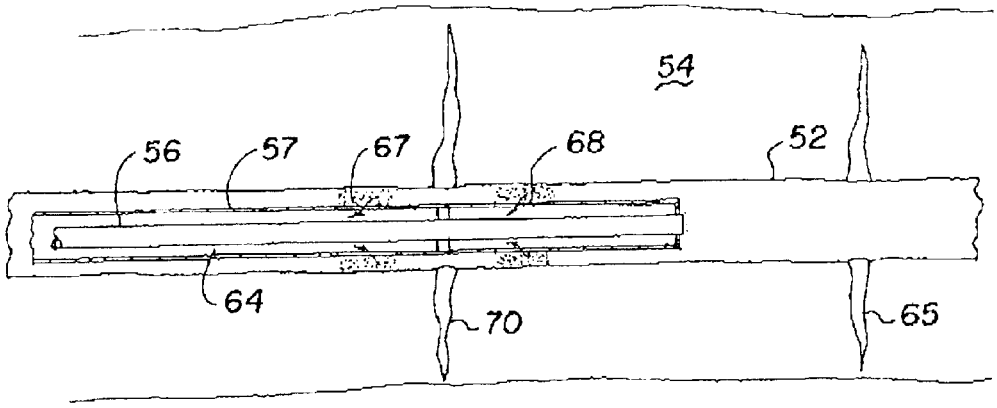
FIGS. 5 and 6 are schematic illustrations with parts broken away of a horizontal well section showing sequential operations within the well section.
Figure 6:
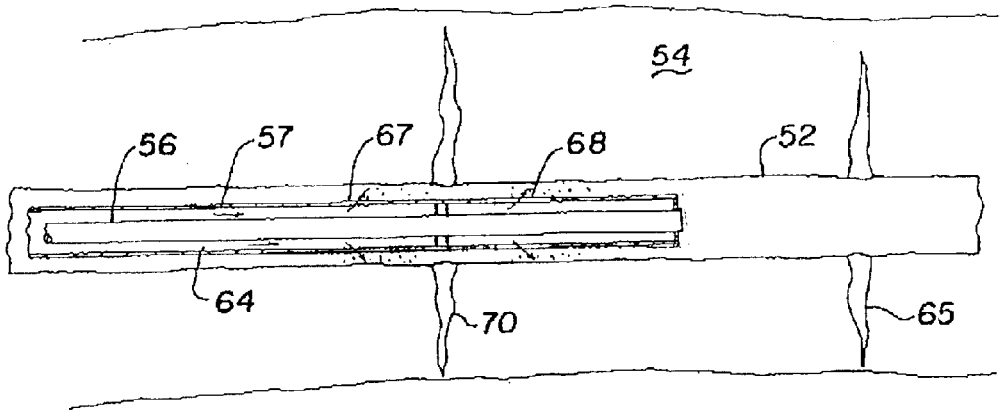

In the stimulation of formations penetrated by horizontal or deviated wells as shown in FIG. 4, it is sometimes desirable to form a series of spaced vertical fractures. This sequence of operation is shown by FIGS. 5 and 6. FIG. 5 illustrates the location of the tubing strings 56 and 57 at a second location moved uphole from the initial location where fracture 65 was formed. The circulation procedure is repeated to again provide spaced bridge packings 67 and 68 followed by a fracturing operation in order to form a second fracture system 70 spaced horizontally from the first fracture system 65. Thereafter, circulation is reversed as indicated in FIG. 6 with a carrier liquid (without particulate plugging agents) circulated down the annulus 64 to disrupt the bridge packings with return of fluid up the inner tubing string 56 and, if desired, also within the well-tubing annulus 62. If desired, the process can be repeated by again moving the tubing assembly uphole and forming new bridge packings at yet another location followed by fracturing to produce a third vertical fracture system spaced from the systems 65 and 70.

Usually in carrying out the invention in deviated wells as depicted in FIGS. 4 through 6, it will be preferred to employ a concentric tubing arrangement rather than a parallel tubing arrangement configuration of the type depicted in FIG. 2. When using the concentric tubing arrangement, suitable centralizers can be employed along the length of the concentric tubing strings in order to maintain the generally annular spacing shown.

Figure 7:
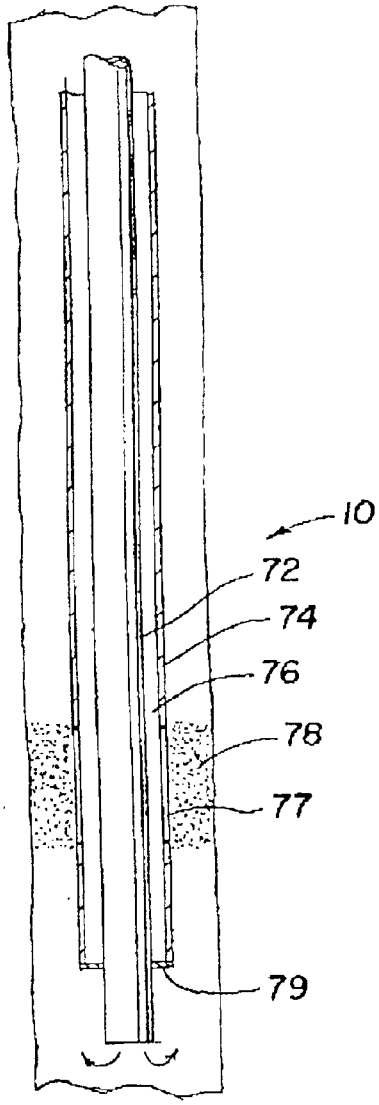
FIG. 7 is a schematic illustration of a well with parts broken away showing the application of the invention in forming a single bridge packing with a concentric tubing string assembly.

A further embodiment of the invention, as carried out employing only a single bridge packing, is shown in FIG. 7. In the system of FIG. 7, a concentric tubing arrangement similar to that shown in FIG. 1 is employed with the exception that the interior tubing string 72 extends through the bottom of the exterior tubing string 74. The exterior tubing string is provided with a suitable closure element 79 in order to seal the annulus 76 between the inner and outer tubing strings at the bottom. In this embodiment of the invention, normally carried out near the bottom of a well, the dispersion of plugging agent in the carrier liquid is circulated down tubing string 72 and into the well bore. The carrier liquid is returned from the well bore through string screen 77 into the tubing annulus 76 to form a bridge packing 78 similarly as described previously. Once the packing is formed, a suitable treating operation can be carried out by the injection of a treating fluid such as a fracturing fluid or an acidizing fluid down the interior tubing string 72 into the well section below the bridge packing 78. At the conclusion of the treating operation, flow can be reversed by circulating the carrier liquid down the tubing annulus 76 to displace the accumulation of particulate plugging agent away from the screen section 77.

Figure 8:
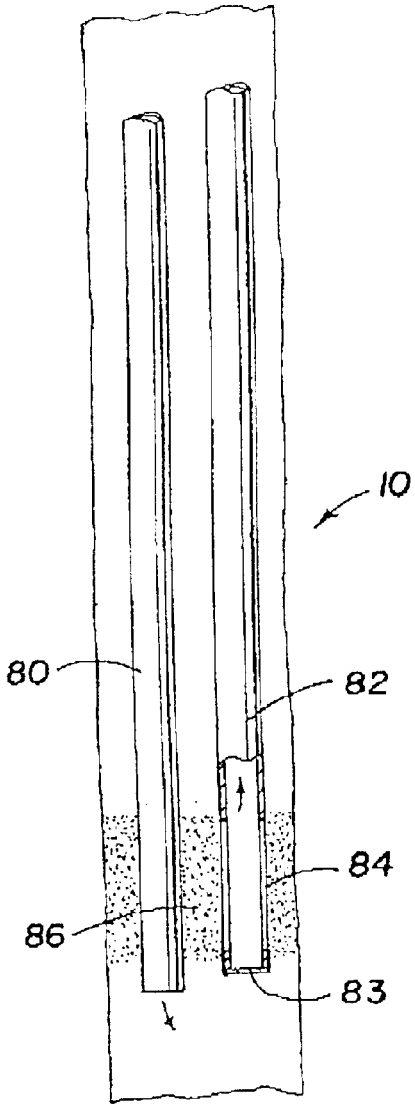
FIG. 8 is a schematic illustration of a well with parts broken away showing the application of the invention in forming a single bridge packing with parallel tubing string configuration.

FIG. 8 illustrates a parallel tubing string configuration employed to provide a single bridge packing. Here, tubing string 80 is open at the bottom, and tubing string 82 is provided with a closure 83 and a screen section 84 spaced upwardly from the lower end of the tubing string. A carrier liquid containing a particulate plugging agent in suspension is circulated down tubing string 80 through the screen section and up tubing string 82 in order to form a bridge packing 86. The treating operation can be carried out through tubing string 80, and at the conclusion of the treating operation, reverse circulation down tubing 82 is instituted to disrupt the bridge packing 86, similarly as described above.

The invention as thus far described involves the use of separate tubing strings run in parallel or concentrical configuration from the wellhead to the vicinity of the formation undergoing treatment. While applications of this nature are useful, particularly in relatively shallow wells, the tubing arrangements involved become relatively cumbersome when the invention is carried out in wells of substantial depth, particularly where the depth of the well to the formation undergoing treatment exceeds about 1,000–2,000 ft. In such cases it will usually be desirable to run a well tool providing separate flow paths as described above on a single tubing string equipped with a packer. If desired, the packer may be equipped with a flow control tool of conventional configuration to permit different flow paths from the surface of the well to the downhole location through a single tubing string and/or through the tubing-casing annulus.

Figure 9:
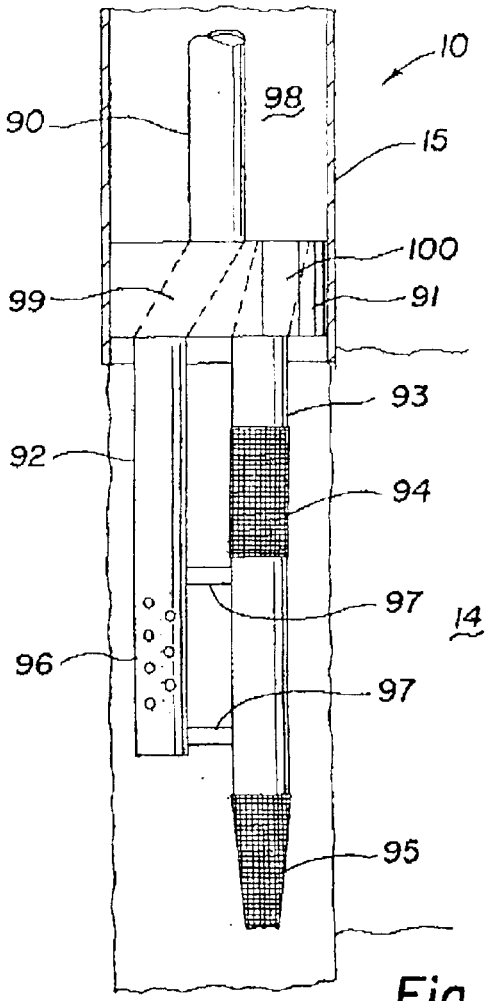
FIG. 9 is a side elevation with parts broken away showing a downhole well assembly suitable for use in carrying out the present invention.

Turning to FIG. 9, there is illustrated a well 10 having a single tubing string 90 extending from the surface of the well (not shown). Supported on the tubing string 90 is a mechanical packer 91 which supports sections of tubings 92 and 93. Tubing section 93 is equipped with upper and lower screen sections 94 and 95 and is analogous in operation to the tubing string 40 described above with reference to FIG. 2. Tubing string 92 is provided with a perforated section 96 and is analogous in operation to the tubing string 38 described above with reference to FIG. 2. The tubing sections 92 and 93 are secured to one another in a fixed space location by the packer 91 and by means of spacing elements 97 extending between the tubing sections. Spacing elements 97 do not, of course, provide fluid passages between the tubing sections. Tubing 92 can be placed in fluid communication with the tubing string 90 through a passageway 99 in the packer, and the interior of tubing string 93 placed in fluid communication with the tubing-casing annulus 98 by means of passageway indicated by broken lines 100. In operation of the well tool shown in FIG. 9, a suspension of the particulate plugging agent in a suitable carrier liquid is circulated down the well via tubing 90 and exits into the well bore via perforations 96. The carrier liquid is circulated through screen sections 94 and 95, which are configured as described previously, to permit the passage of the carrier liquid but retain the particulate plugging agent on the screen sections to form bridge packings (not shown) similarly as described above. Return flow in the configuration shown is through the tubing-casing annulus 98. The lower screen section 95 is tapered as described previously in order to facilitate removal of the well tool. At the conclusion of the treating operation carried out through tubings 90 and 92, carrier liquid may be circulated down the tubing casing annulus 98 into tubing section 93. At the same time, the packer 97 may be released, and upward strain imposed by the working tubing 90 with the tapered screen section 95 facilitating removal from the lower bridge packing as described previously.

Figure 10:
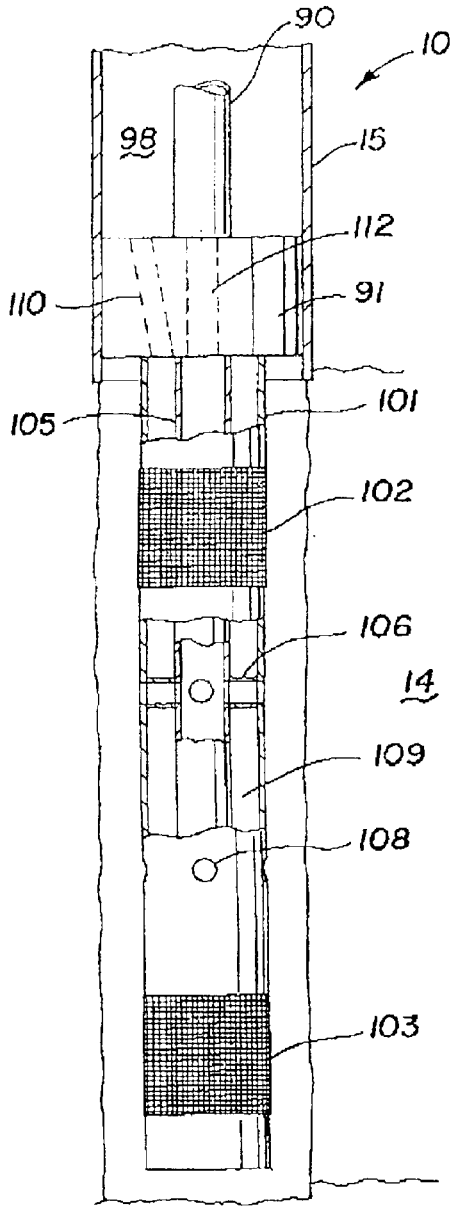
FIG. 10 is a side elevation with parts broken away showing another form of a downhole well assembly suitable for use in carrying out the present invention.

FIG. 10 is a side elevation with parts broken away of a downhole tool incorporating concentric tubing sections, which function similarly as described above with reference to FIG. 1. In FIG. 10, like elements as are shown in FIG. 9 are designated by the same reference numerals as used in FIG. 9. In the tool of FIG. 10, an outer concentric tubing 101 is provided with upper and lower screen sections 102 and 103. Also suspended from the packer 91 is a concentric inner tubing section 105, which is provided with an upper spider section 106 and a lower spider section (not shown) terminating in perforations in the outer tubing section 101 indicated by reference numeral 108. The spider sections provide flow passages from the interior of tubing section 105 to the exterior of the tubing string 101. The annulus 109 between the inner and outer tubing strings is placed in fluid communication with the tubing-casing annulus 98 through a passageway 110 in the packer 91 as indicated by broken lines. The interior of the tubing string 105 is placed in fluid communication with the working tubing string 90 as indicated by the broken line passageway 112. The operation of the well tool shown in FIG. 10 is similar as that described above with reference to FIG. 1. The carrier liquid containing the particulate plugging agent is introduced into the well through tubing 90 into tubing section 105 and thence outwardly through the spider passageways to the exterior of outer tubing section 101. Return flow is directed into annulus 109 and then upwardly through the tubing-casing annulus 98 to form bridge packings (not shown) adjacent screen sections 102 and 103.

Figure 11:
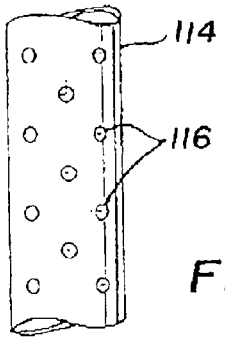
FIG. 11 is a side elevation of a tubing section employed in a preferred screen section for use in the present invention.

As disclosed previously, the screen sections employed in the present invention may be of any suitable type but normally will take the form of a 0.006–0.01 inch mesh screen. FIG. 11 shows a suitable screen section configuration in which the screen section of the tubing 114 is provided with perforations 116. A wire mesh screen (not shown) is wrapped around the perforated section of pipe 114. The pipe functions to support the screen element. In addition, by appropriately sizing the perforations 116 when the reverse circulation carrier liquid is pumped down the well flow and flow through the constricted perforations 111, it exits at a relatively high velocity, thus facilitating disruption of the particulate bridging agent around the screen section.

As described previously, the present invention may be carried out employing treating fluids other than those commonly used in acidizing, fracturing, or acid fracturing operations. A treating fluid may take the form of a solvent, other than an acidizing fluid, in order to remove material immediately adjacent the well bore to facilitate fluid flow between the well bore and the formation. Alternatively, a treating agent in the nature of a plugging agent can be introduced into the well in order to seal a section of the formation intermediate the bridge packings formed adjacent the screen sections. For example, a suspension of a thermoset polymer may be introduced into the well, followed by the introduction of a setting agent to crosslink the polymer and form a seal within a limited portion of the well bore. Suitable materials useful in the embodiment of this nature include crosslinked hydroxyethylcellulose.

The screen sections employed in the various embodiments of the invention may, as noted previously, be relatively short, e.g., on the order of about one or two feet. However, as a practical matter, screen sections will usually be provided ranging in lengths from about 5 to 20 feet. The interval between screen sections may range from a low as 2 feet up to perhaps 60 feet in length, depending upon the formation interval to be treated. However, a typical spacing between the screen sections will be about 10–30 feet from the top of the lower screen section to the bottom of the upper screen section.

From the foregoing description, it will be recognized that the viscosity of the carrier liquid and the particle size range and density of the particulate plugging agent are interrelated. In addition, the size of the screen openings is related to the characteristic of the particulate plugging agent since all or most of the plugging agent should be retained on the screen to form the bridge packing. The particulate plugging agent preferably will take the form of a sand/gravel mixture having a specific gravity of about 1.5–3.5 with a particle size distribution which promotes packing of the relatively fine sand particles within the interstices formed by the somewhat coarser gravel particles. For example, a suitable particulate plugging agent may comprise about 40–60 wt. % gravel having a particle size distribution of about 20–40 mesh and a relatively fine 40–60 mesh size sand portion comprising about 40–60 wt. % of the mixture. For such a particulate plugging agent, the viscosity of the carrier liquid should be within the range of about 20–200 centipoises. The screen section may take the form of a 0.006–0.01 inch mesh screen. Where the screen is wrapped around underlying perforated pipe as shown in FIG. 11, the perforations may have a diameter of about ⅛–⅜ inches with about 2–50 perforations per foot of pipe.

Having described specific embodiments of the present invention, it will be understood that modifications thereof may be suggested to those skilled in the art, and it is intended to cover all such modifications as fall within the scope of the appended claims.

What is claimed:

1. In the treatment of a well extending from a well head into a subterranean formation, the method comprising:

(a) circulating a plugging fluid comprising a suspension of a particulate plugging agent in a carrier liquid down said well through a first flow path within said well and into said well in contact with the wall of said well within said subterranean formation;

(b) separating said liquid from said particulate plugging agent by circulating said plugging fluid into a second flow path within said well through a set of screen openings allowing the passage of said carrier liquid while retaining said particulate plugging agent in contact with said set of openings to cause said plugging agent to accumulate to form a bridge packing within said well to establish an interval within said well which is isolated from the remainder of said well; and (c) subsequent to the establishing of said bridge packing, introducing a treating fluid into the isolated interval of the well and into contact with the surface of said formation in said well adjacent to said accumulated plugging agent defining said bridge packing.

2. The method of claim 1 further comprising, subsequent to the treatment of subparagraph (c), circulating a clean-up fluid down said well into said second flow path to displace accumulated particulate plugging agent away from said openings and disrupt said bridge packing.

3. The method of claim 1 wherein said treating fluid is injected into said isolated interval under a pressure sufficient to hydraulically fracture said formation.

4. The method of claim 1 wherein said treating fluid is an acidizing fluid.

5. The method of claim 1 further comprising circulating said plugging fluid through to said second flow path through a second set of screen openings spaced linearly along said well from said first set of screen openings to form a second bridge packing within said well spaced linearly from said first recited bridge packing.

6. The method of claim 1 wherein said particulate plugging agent has a particle size distribution provided by a relatively coarse fraction of said particulate plugging agent and a relatively fine fraction of said particulate plugging agent having on an average partial size less then the average portion particle size of said course fraction.

7. The method of claim 6, wherein said course fraction has a particle size within the range of 20–40 mesh size and said fine fraction has a particle size within the range of 40–60 mesh size.

8. In the treatment of a section of a well penetrating a subterranean formation and having a return tubing provided with spaced screen sections at a location in said well adjacent said subterranean formation and a working tubing opening into the interior of the well intermediate said screen sections, the method comprising:

(a) circulating a plugging fluid comprising a suspension of a particulate plugging agent in a carrier liquid through said working tubing into the intermediate interval between said screen sections and flowing said carrier liquid into said return tubing through openings in said spaced screen sections which allow the passage of said carrier liquid while retaining said particulate plugging agent in said well in contact with said screen sections;

(b) continuing the flow of said plugging fluid until the particulate plugging agent in said fluid accumulates in said well adjacent said screen sections to form spaced bridge packings within said well and surrounding said return tubing; and (c) thereafter introducing a treating fluid into said well and into the interval of said well intermediate said spaced bridge packings and forcing said treating fluid into said formation.

9. The method of claim 8 further comprising, subsequent to the treatment of subparagraph (c), circulating a cleanup fluid down said well into said return tubing to displace accumulated particulate plugging agent away from said screen sections and disrupt said bridge packings.

10. The method of claim 9 further comprising, subsequent to subparagraph (c), thereafter removing said return tubing and working tubing longitudinally through said well bore to arrive at a second location within said well spaced from said first recited location and thereafter repeating the operation set forth in subparagraphs (a), (b), and (c) to treat a different section of said well bore.

11. The method of claim 8 wherein said treating fluid is injected into said treating interval under a pressure sufficient to hydraulically fracture said formation.

12. The method of claim 8 wherein said treating fluid is an acidizing fluid.

13. The method of claim 8 wherein said return and working tubings are oriented parallel in said well.

14. The method of claim 8 wherein said return and working tubing are concentrically oriented in said well with the working tubing disposed within the return tubing to provide a return pathway between the annulus of the working tubing and the return tubing.

15. The method of claim 14 wherein said well section extends in a horizontal orientation within said subterranean formation.

16. The method of claim 15 wherein said treating fluid is injected into said treating interval under a pressure sufficient to hydraulically fracture said formation and form a vertically oriented fracture within said formation.

17. The method of claim 16 further comprising, subsequent to forming said vertically oriented fracture, moving said return and working tubings longitudinally through said horizontally extending well section to a second location within said well section spaced from said first recited location and thereafter circulating said plugging fluid down said well through a first flow path within said well and into said well in contact with the wall of said well within said subterranean formation, and separating said liquid from said particulate plugging agent by circulating said plugging fluid into a second flow path within said well through a set of screen openings allowing the passage of said carrier liquid while retaining said particulate plugging agent in contact with said set of openings to cause said plugging agent to accumulate to form a bridge packing within said well to establish an interval within said well which isolated from the remainder of said well, and repeating the steps of circulating and separating to form a second set of spaced bridged packings and thereafter introducing said treating fluid into the interval of said well intermediate second set of spaced bridged packings under a pressure sufficient to hydraulically fracture said formation to form a second vertically oriented fracture within said well section spaced from said first recited vertically oriented fracture.

18. In the treatment of a well penetrating a subterranean formation, the method comprising:

(a) providing a packer in said well, supporting a downwardly depending working tubing segment opening into said well and a downwardly depending return tubing segment having at least one screen section;

(b) flowing a plugging fluid comprising a suspension of a particulate plugging agent in a carrier liquid through a first flow path in said packer and through said working tubing segment into said well and flowing said carrier liquid into said return tubing segment through openings in said screen section which allow the passage of said carrier liquid while retaining said particulate plugging agent in said well in contact with said screen section;

(c) continuing the flow of said plugging fluid down said well into said working tubing segment until the particulate plugging agent in said fluid accumulates in said well to form a bridge packing within said well to provide an isolated treatment interval within said well;

(d) subsequent to the establishment of said bridge packing introducing a treating fluid into said isolated interval of said well and into contact with the surface of said formation in said well adjacent to the accumulated plugging agent defining said bridge packing; and (e) thereafter circulating a clean-up fluid down said well and into said return tubing segment to displace accumulated particulate plugging agent away from said screen section and disrupt said bridge packing.

19. The method of claim 18 wherein said return tubing segment has a second screen section spaced longitudinally from said first recited screen section and said carrier liquid is flowed into said return tubing segment through openings in said second screen section while retaining said particular plugging agent in said well in contact with said second screen section to form a second bridge packing in said well spaced longitudinally from said first recited bridge packing to provide said isolated interval within said well.

20. The method of claim 19 wherein said working tubing segment and said return tubing segments are oriented in a parallel relationship to one another in said well.

21. The method of claim 19 wherein said return tubing segment and said working tubing segment are concentrically oriented in said well with the working tubing segment disposed within the return tubing segment to provide a return pathway between the annulus of the working tubing segment and the return tubing segment.

22. In a downhole well treating system the combination comprising:

(a) a packer adapted to be inserted into a well;

(b) a return tubing segment supported on and extending downwardly from said packer and having an upper screen section in relative proximity to said packer and a lower screen section spaced longitudinally from said upper screen section to provide a treatment interval between said upper and lower screen sections; and (c) a working tubing segment supported on and extending downwardly from said packer and opening into the treatment interval section between said upper and lower screen sections to provide for the flow of fluid through said packer and into the treatment interval between said upper and lower screen sections when a tool is inserted into a well.

23. The system of claim 22 wherein said return and working tubing segments are secured to said packer in a parallel orientation to each other.

24. The system of claim 23 wherein said lower screen of said return tubing segment is located at the bottom of said return tubing segment and is tapered downwardly to provide a lower portion of said screen section of reduced diameter.

25. The system of claim 22 wherein said return and working tubing segments are concentrically oriented with one another to provide an annulus between the outer surface of said working tubing and the inner surface of said return tubing segment and comprising a spider section located between said upper and lower screen sections providing at least one flow passage from the interior of said working tubing segment to the exterior of said return tubing segment.

* * * * *